US009517645B2

(12) United States Patent
Iijima et al.

(10) Patent No.: US 9,517,645 B2
(45) Date of Patent: Dec. 13, 2016

(54) SHEET CONVEYER DEVICE AND INKJET RECORDING APPARATUS

(71) Applicant: BROTHER KOGYO KABUSHIKI KAISHA, Nagoya-shi, Aichi-ken (JP)

(72) Inventors: Shota Iijima, Aichi (JP); Masao Mimoto, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/865,680

(22) Filed: Sep. 25, 2015

(65) Prior Publication Data

US 2016/0089910 A1 Mar. 31, 2016

(30) Foreign Application Priority Data

Sep. 25, 2014 (JP) ..... 2014-194540

(51) Int. Cl.

| | |
|---|---|
| ***B41J 3/60*** | (2006.01) |
| ***B41J 13/00*** | (2006.01) |
| ***B65H 5/06*** | (2006.01) |
| ***B65H 5/36*** | (2006.01) |
| ***B65H 5/00*** | (2006.01) |

(52) U.S. Cl.

CPC ..... *B41J 13/009* (2013.01); *B41J 3/60* (2013.01); *B65H 5/00* (2013.01); *B65H 5/062* (2013.01); *B65H 5/068* (2013.01); *B65H 5/36* (2013.01)

(58) Field of Classification Search

CPC ..... B41J 3/60; B41J 3/009; B65H 2301/3331; B65H 29/60; B65H 5/00; B65H 6/60; B65H 5/68; B65H 5/62

See application file for complete search history.

(56) References Cited

U.S. PATENT DOCUMENTS

| | | | | |
|---|---|---|---|---|
| 5,132,742 | A * | 7/1992 | Goto | 399/401 |
| 5,553,528 | A * | 9/1996 | Zoltner | 83/443 |
| 2004/0239743 | A1 | 12/2004 | Ohashi et al. | |
| 2013/0083146 | A1* | 4/2013 | Iijima | 347/104 |

FOREIGN PATENT DOCUMENTS

| | | | |
|---|---|---|---|
| JP | 2004-315195 | A | 11/2004 |
| JP | 2010208853 | A * | 9/2010 |

* cited by examiner

*Primary Examiner* — Matthew G Marini
(74) *Attorney, Agent, or Firm* — Merchant & Gould P.C.

(57) ABSTRACT

A conveyer device, including a chassis defining a first conveyer path and a second conveyer path; a pair of path members opposing to each other to form a part of the first conveyer path; a flapper configured to be pivotable among a first condition, wherein the flapper blocks the first conveyer path, a second condition, wherein the flapper allows the sheet conveyed in the conveying direction to pass thereby, and a third condition, wherein the flapper is separated from an opposing member; an urging member to urge the flapper; and a movable member movable between a first position, wherein the flapper in the first condition is contactless from the movable member, and a second condition, wherein the movable member contacts the flapper, is provided. The movable member separates one of the pair of path members from the other when moving from the first position to the second position.

14 Claims, 10 Drawing Sheets

SHEET CONVEYER DEVICE AND INKJET RECORDING APPARATUS

CROSS REFERENCE TO RELATED APPLICATION

This application claims priority from Japanese Patent Application No. 2014-194540, filed on Sep. 25, 2014, the entire subject matter of which is incorporated herein by reference.

BACKGROUND

Technical Field

The present invention relates to a conveyer device capable of conveying a sheet and an inkjet recording apparatus having the conveyer device.

Related Art

An inkjet recording apparatus having a conveyer device, which is capable of conveying a sheet, to record an image on either side of the sheet, is known. The inkjet recording apparatus may have a flapper interposed at a position, where a linear path is joined by an inverting path. The flapper may be arranged to block the linear path at a predetermined condition and may be pushed by the sheet being conveyed in the linear path to pivot and yield the linear path.

SUMMARY

In the sheet-reversible recording apparatus, when a sheet is jammed in the linear path, the flapper blocking the linear path at the predetermined condition may interfere with an operation to clear the sheet jam. In other words, operability to solve the sheet jam may be lowered by the flapper.

In order to clear the sheet jam more easily, an operation handle engaged with the flapper may be moved to manipulate the flapper to pivot in the predetermined blocking condition forcibly. In the meantime, if the operation handle is maintained engaged with the flapper at all time, the flapper may be affected by an external force transmitted through the operation handle, and a posture of the flapper in the predetermined blocking condition may not be stabilized.

The present disclosure is advantageous in that a conveyer device and an inkjet recording apparatus, in which a posture of a flapper to block a conveyer path may be stabilized while sheet jam may be easily handled, are provided.

According to an aspect of the present disclosure, a conveyer device is provided. The conveyer device includes a chassis defining a first conveyer path, in which a sheet is conveyed in a conveying direction, and a second conveyer path, in which the sheet is conveyed and guided to reenter the first conveyer path; a pair of path members arranged to oppose to each other and define a part of the first conveyer path; a flapper disposed along the first conveyer path at a joint point, at which the first conveyer path and the second conveyer path are jointed, the flapper being configured to be pivotable among a first condition, in which the flapper blocks the first conveyer path and guides the sheet being conveyed in a reverse direction opposite from the conveying direction to the second conveyer path, a second condition, in which the flapper allows the sheet being conveyed in the conveying direction to pass thereby, and a third condition, in which the flapper is separated from an opposing member arranged to oppose to the flapper, the opposing member being arranged to contact the flapper when the flapper is in the first condition; an urging member configured to urge the flapper toward the first condition; and a movable member configured to be movable between a first position, in which the flapper in the first condition is contactless from the movable member, and a second condition, in which the movable member contacts the flapper and moves the flapper to pivot from the first condition to the third condition, the movable member being configured to separate one of the pair of path members from the other of the pair of path members when the movable member moves from the first position to the second position.

According to another aspect of the present disclosure, an inkjet recording apparatus having a chassis and a conveyer device is provided. The chassis defines a first conveyer path, in which a sheet is conveyed in a conveying direction, and a second conveyer path, in which the sheet is conveyed and guided to reenter the first conveyer path. The conveyer device includes a pair of path members arranged to oppose to each other and define a part of the first conveyer path; a flapper disposed along the first conveyer path at a joint point, at which the first conveyer path and the second conveyer path are jointed, the flapper being configured to be pivotable among a first condition, in which the flapper blocks the first conveyer path and guides the sheet being conveyed in a reverse direction opposite from the conveying direction to the second conveyer path, a second condition, in which the flapper allows the sheet being conveyed in the conveying direction to pass thereby, and a third condition, in which the flapper is separated from an opposing member arranged to oppose to the flapper, the opposing member being arranged to contact the flapper when the flapper is in the first condition; an urging member configured to urge the flapper toward the first condition; and a movable member configured to be movable between a first position, in which the flapper in the first condition is contactless from the movable member, and a second condition, in which the movable member contacts the flapper and moves the flapper to pivot from the first condition to the third condition, the movable member being configured to separate one of the pair of path members from the other of the pair of path members when the movable member moves from the first position to the second position. The pair of path members includes: a platen configured to support the sheet in the first conveyer path; and a recording unit arranged along the first conveyer path to oppose to the platen, the recording unit being configured to discharge ink at the sheet supported on the platen. The movable member moving from the first position to the second position separates one of the platen and the recording unit from the other of the platen and the recording unit.

BRIEF DESCRIPTION OF THE ACCOMPANYING DRAWINGS

Figure 3A:
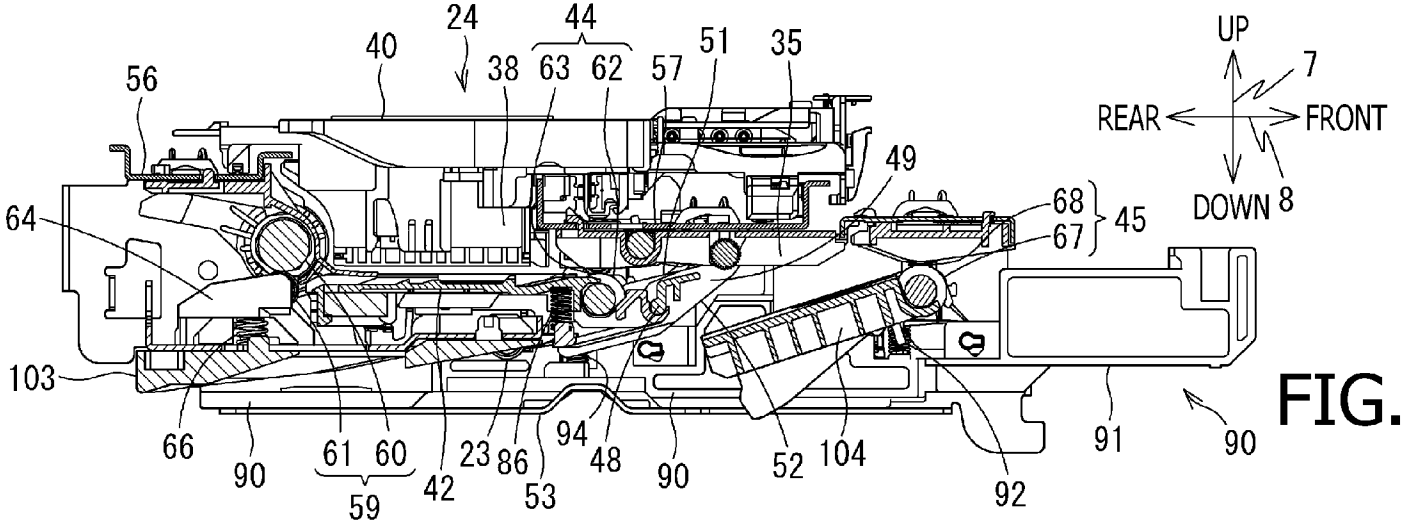
Figure 3B:
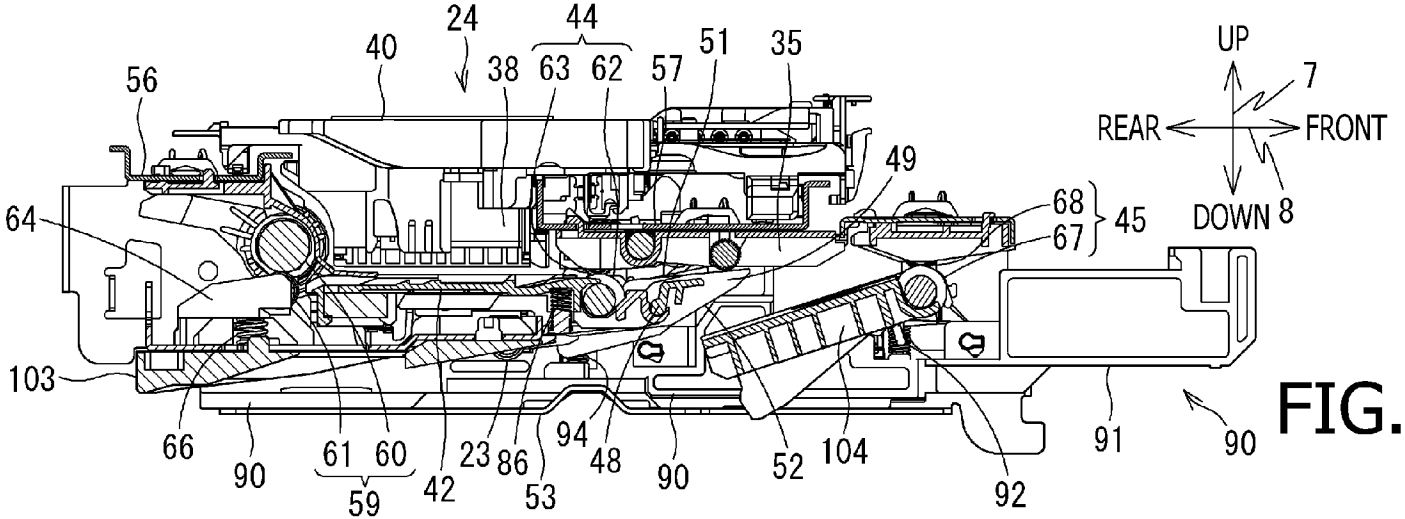

FIG. 3A is a cross-sectional side view of the printer 11 in the MFD 10 according to the embodiment of the present disclosure with a recording unit 24, a flapper 49 being in a first condition, and a movable member 90 being in a first position. FIG. 3B is a cross-sectional side view of the the printer 11 in the MFD 10 according to the embodiment of the present disclosure with the recording unit 24, the flapper 49 being in a second condition, and the movable member 90 being in the first position.

Figure 4:
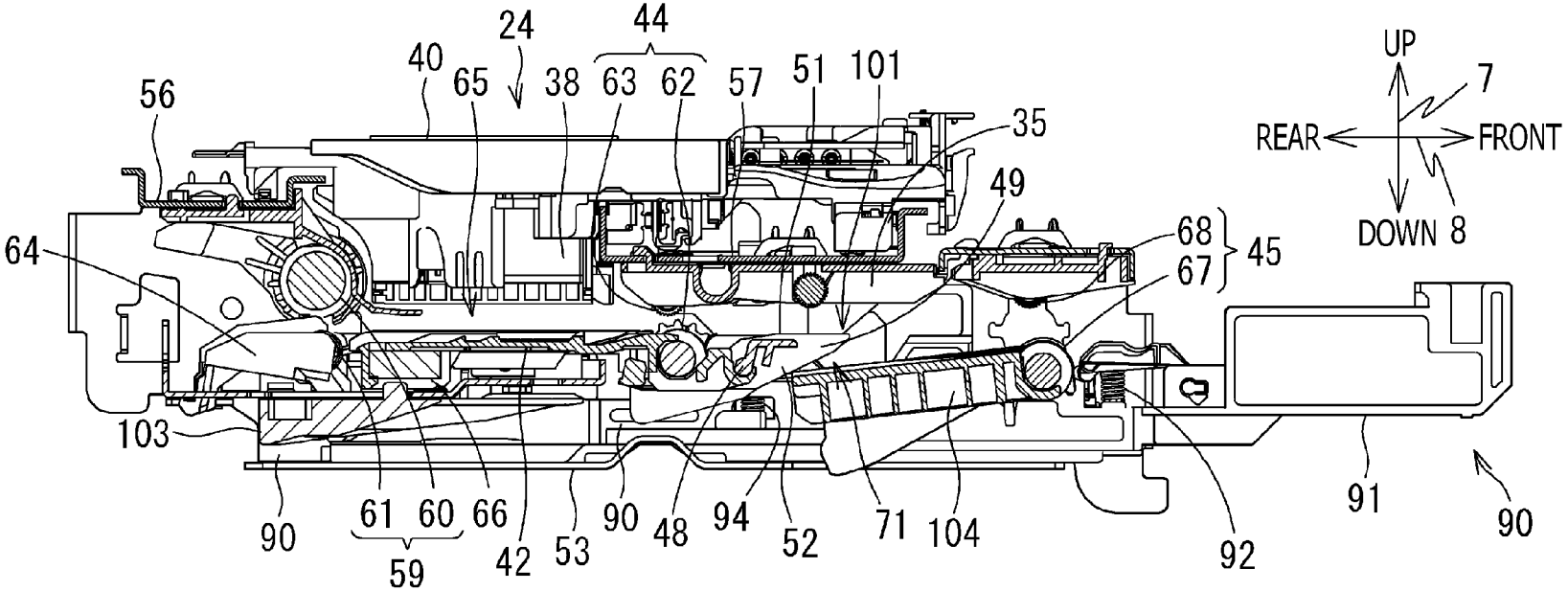

FIG. 4 is a cross-sectional side view of the printer 11 in the MFD 10 according to the embodiment of the present disclosure with the recording unit 24, the flapper 49 being in a third condition, and the movable member 90 being in a second position.

Figure 5:
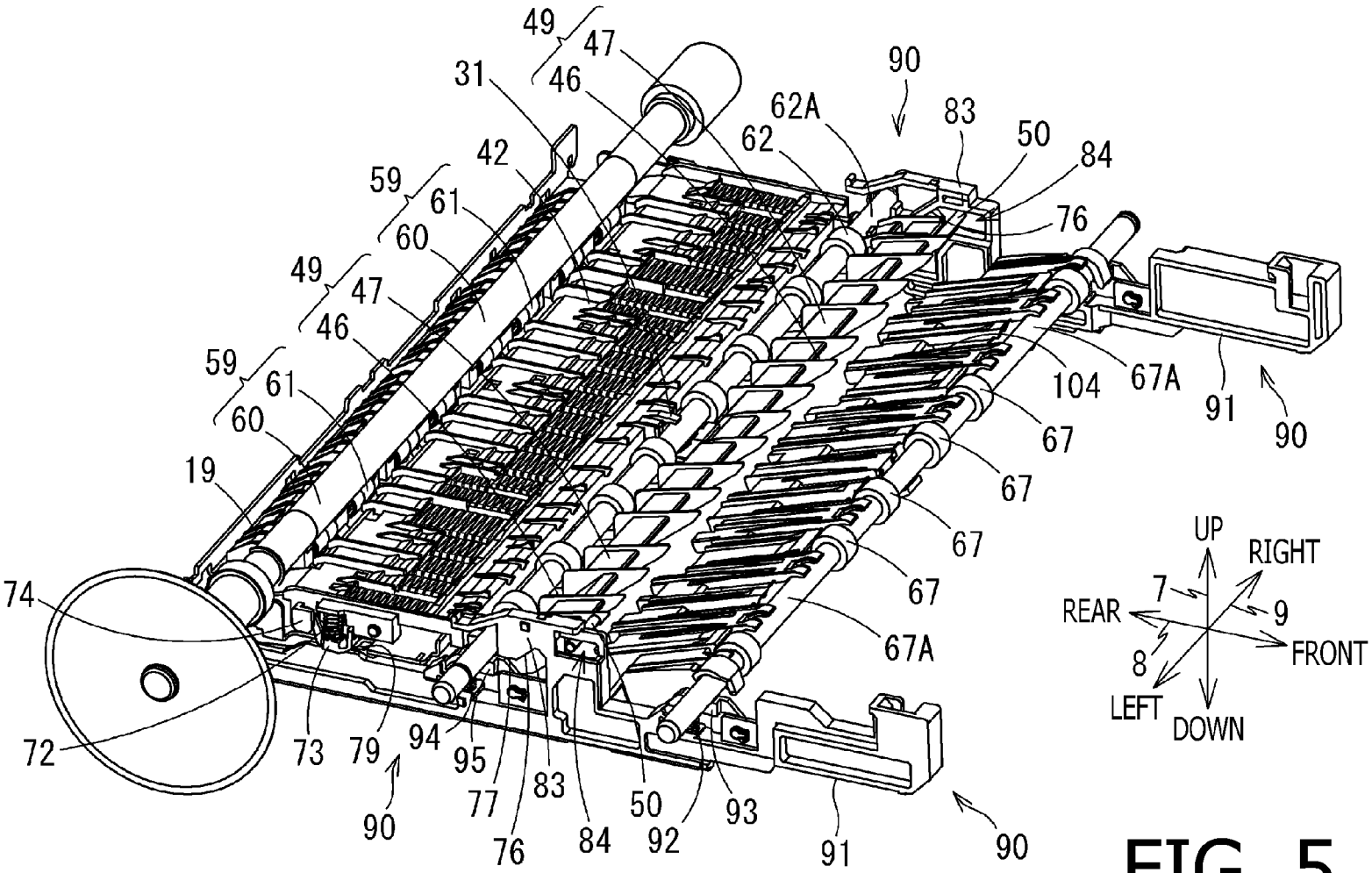

FIG. 5 is a perspective view of the printer 11 in the MFD 10 according to the embodiment of the present disclosure with the flapper 49 being in the first condition and the movable member 90 being in a second position.

Figure 6:
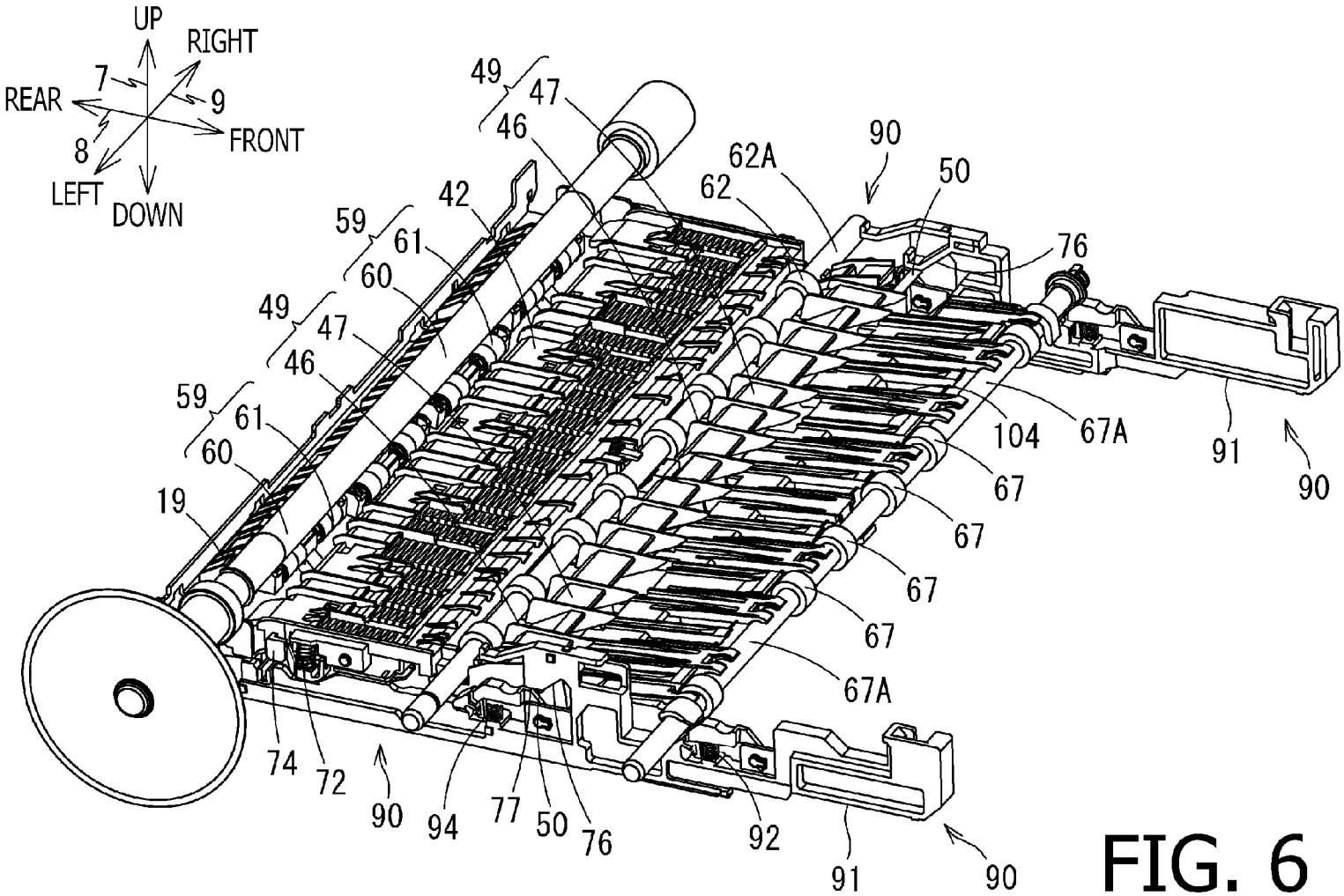

FIG. 6 is a perspective view of the printer 11 in the MFD 10 according to the embodiment of the present disclosure with the flapper 49 being in the third condition and the movable member 90 being in the second position.

Figure 7:
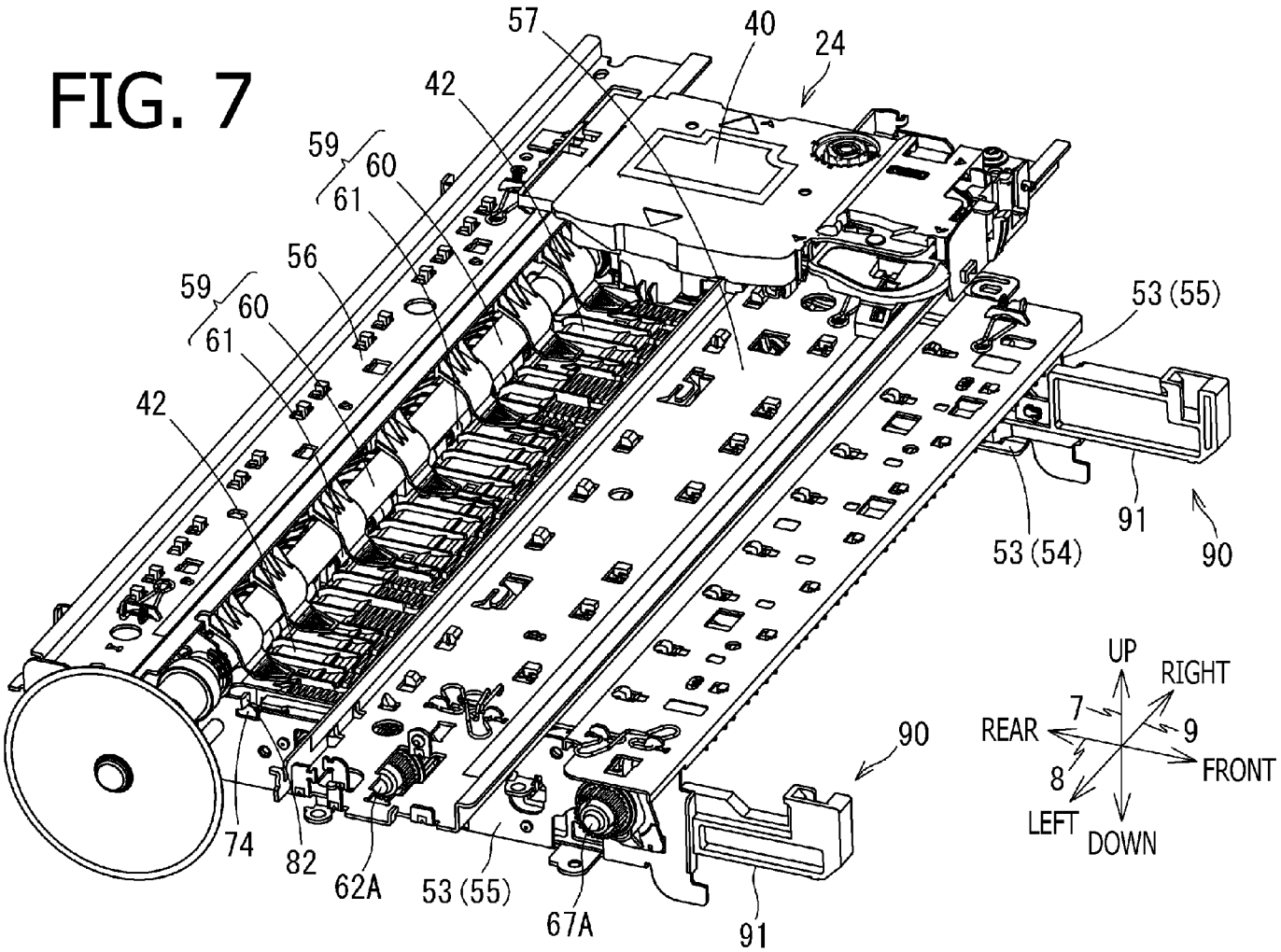

FIG. 7 is a perspective view of the printer 11 in the MFD 10 according to the embodiment of the present disclosure with the recording unit 24 and guide rails 56, 57.

Figure 8:
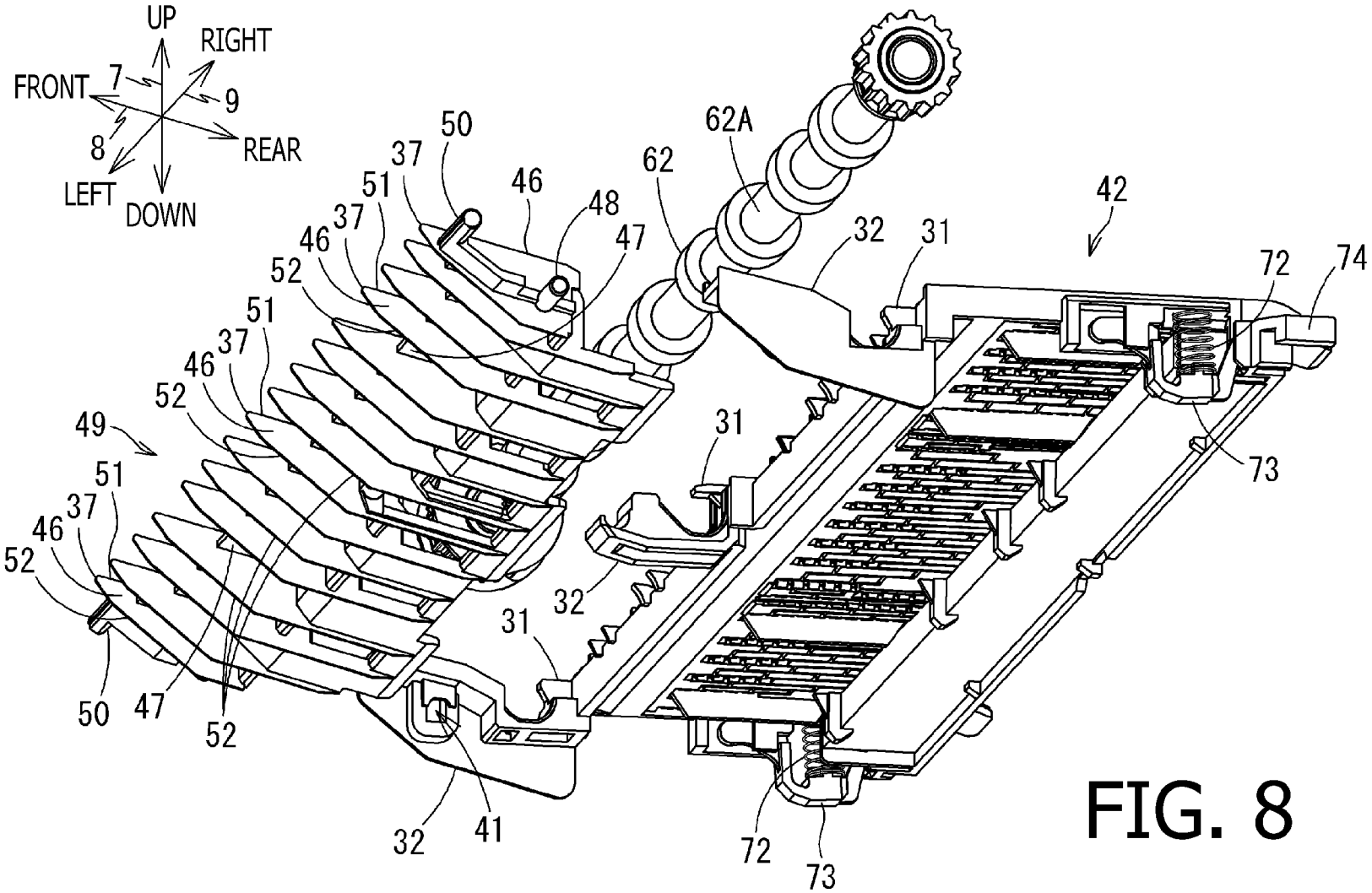

FIG. 8 is an exploded view of the flapper 46, an ejection roller 62, and a platen 42 in the printer 11 according to the embodiment of the present disclosure.

Figure 9:
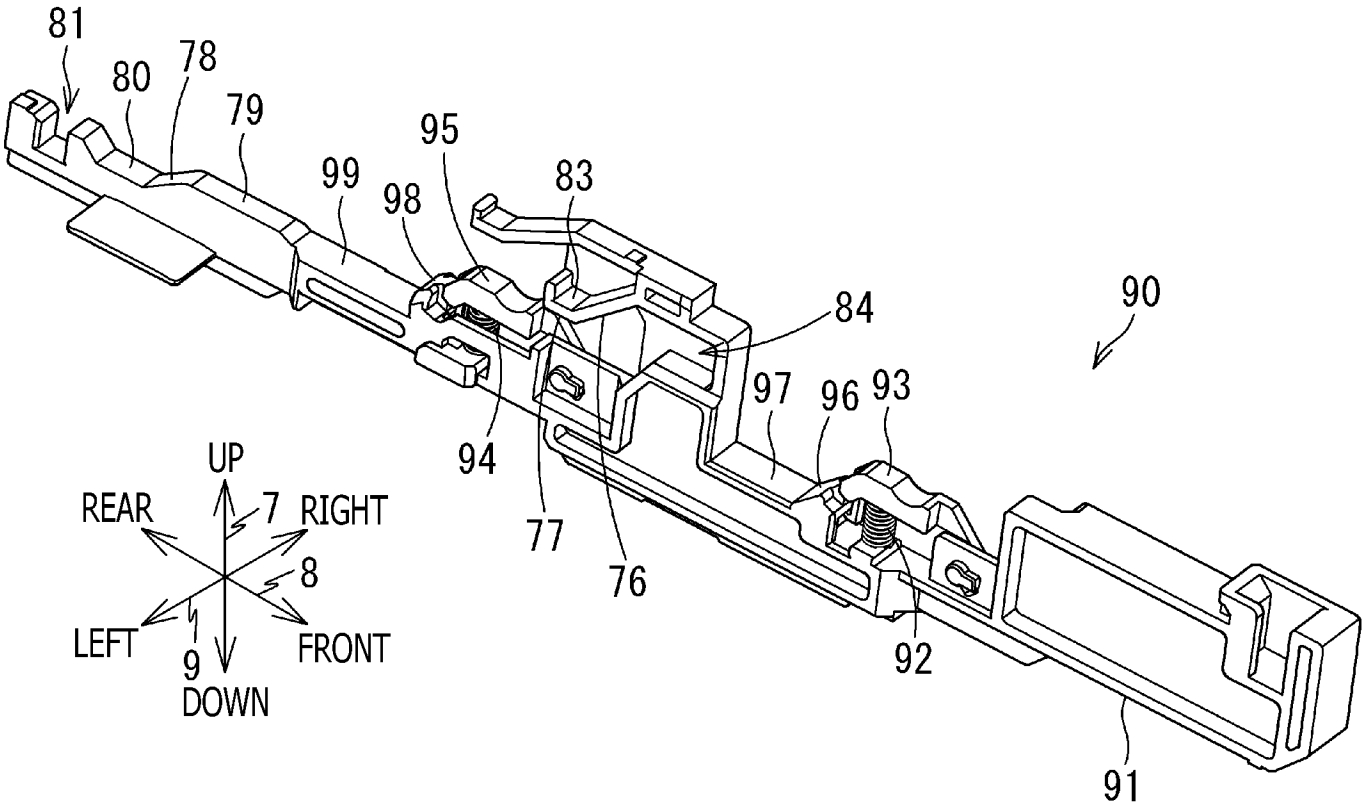

FIG. 9 is a perspective view of the movable member 90 in the printer 11 according to the embodiment of the present disclosure.

Figure 10:
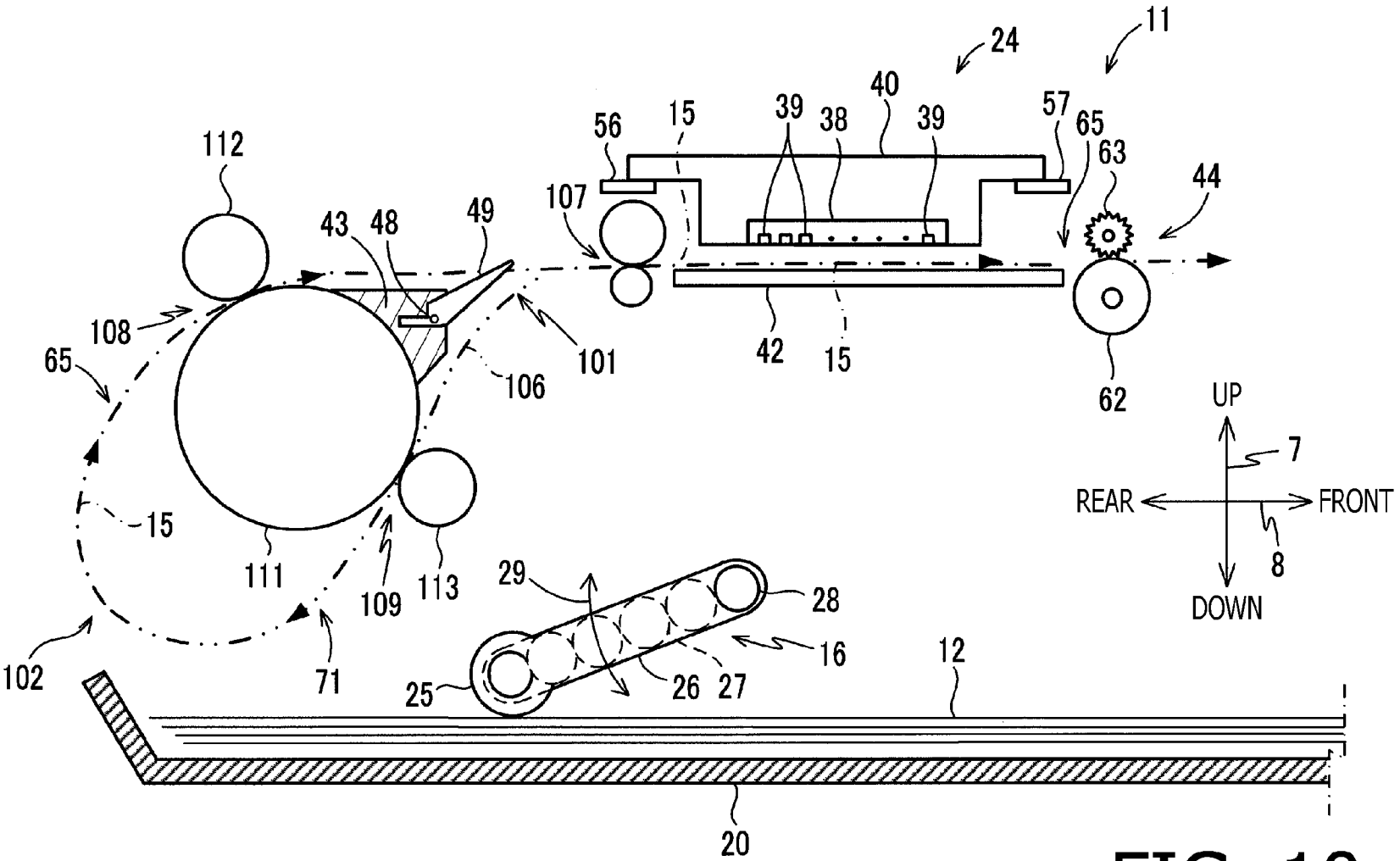

FIG. 10 is a cross-sectional side view of an internal structure of a modified example of the printer 11 in the MFD 10 according to the embodiment of the present disclosure.

DETAILED DESCRIPTION

Hereinafter, an embodiment according to the present disclosure will be described in detail with reference to the accompanying drawings. It is noted that various connections are set forth between elements in the following description. These connections in general and, unless specified otherwise, may be direct or indirect and that this specification is not intended to be limiting in this respect.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-right side in FIG. 1, on which an opening 13 is formed, is defined to be a front side of the MFD 10, and a side opposite from the front side, i.e., a viewer's upper-left side, is defined as a rear side of the MFD 10. A front-to-rear or rear-to-front direction is defined as a direction of depth and may be referred to as a front-rear direction 8. A lower-left side in FIG. 1, which comes on the user's left-hand side with respect to the MFD 10 when the user faces the front side, is referred to as a left side or a left-hand side. A side opposite from the left, which is on the viewer's upper-right side, is referred to as a right side or a right-hand side. A right-to-left or left-to-right direction of the MFD 10 may also be referred to as a right-left direction 9 or a widthwise direction 9. The directions shown in FIGS. 2-10 correspond to those indicated by the arrows appearing in FIG. 1.

[Overall Configuration of the MFD 10]

Figure 1:
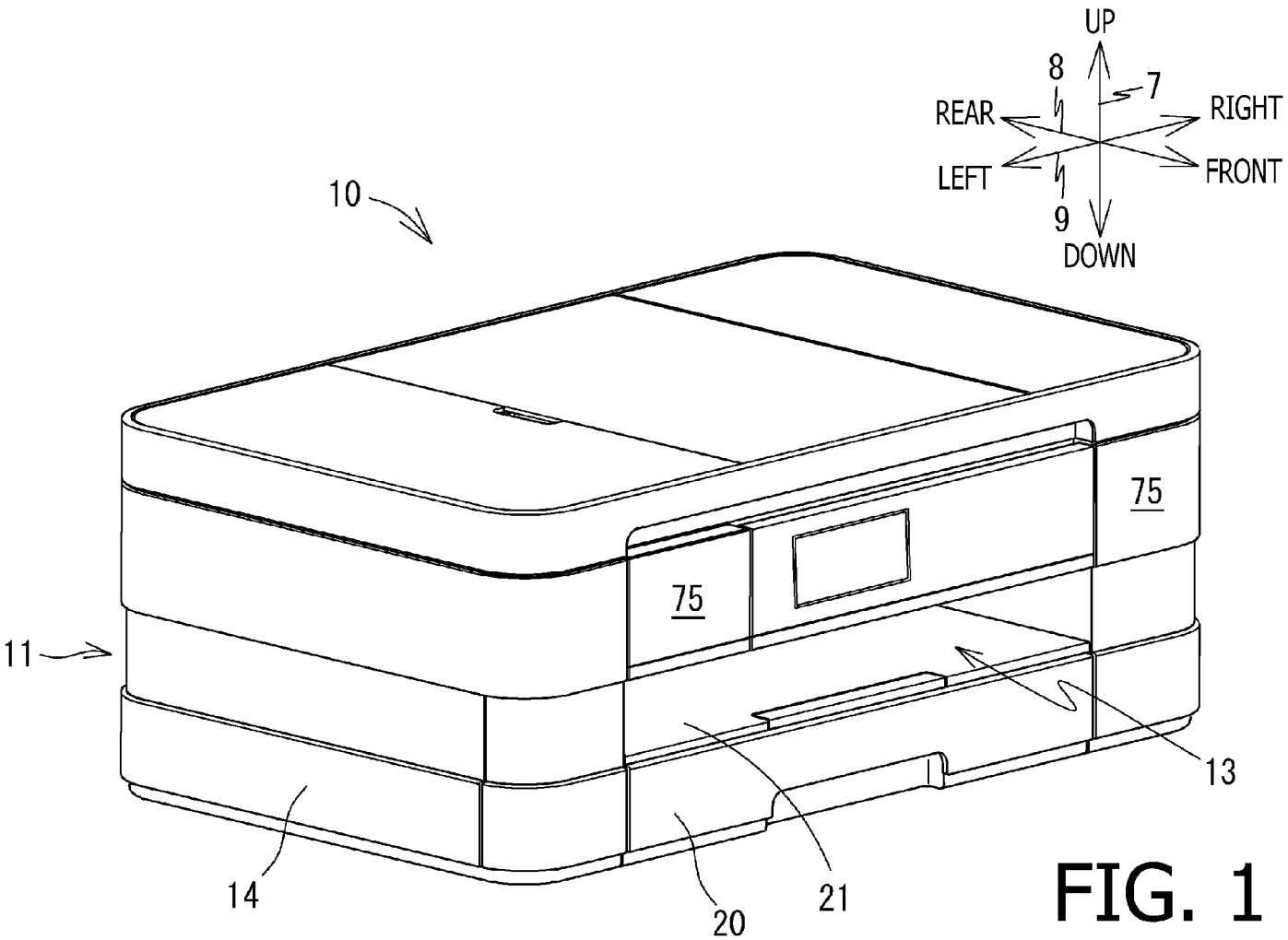
FIG. 1 is an external perspective view of a multifunction device (MFD) 10 according to an embodiment of the present disclosure.

As depicted in FIG. 1, the MFD 10 has an overall shape of a six-sided rectangular box and contains a printer 11, in which an image can be recorded on a recording sheet 12 (see FIG. 2) in an inkjet recording method, in a lower position thereof. In other words, the MFD 10 is equipped with a printing function. The MFD 10 is a multi-functional device having a plurality of functions, including, for example, a facsimile transmission/receiving function and a copier function, additionally to the printing function. The printer 11 is capable of recording an image on either side or both sides of the recording sheet 12 in an inkjet printing method.

Figure 2:
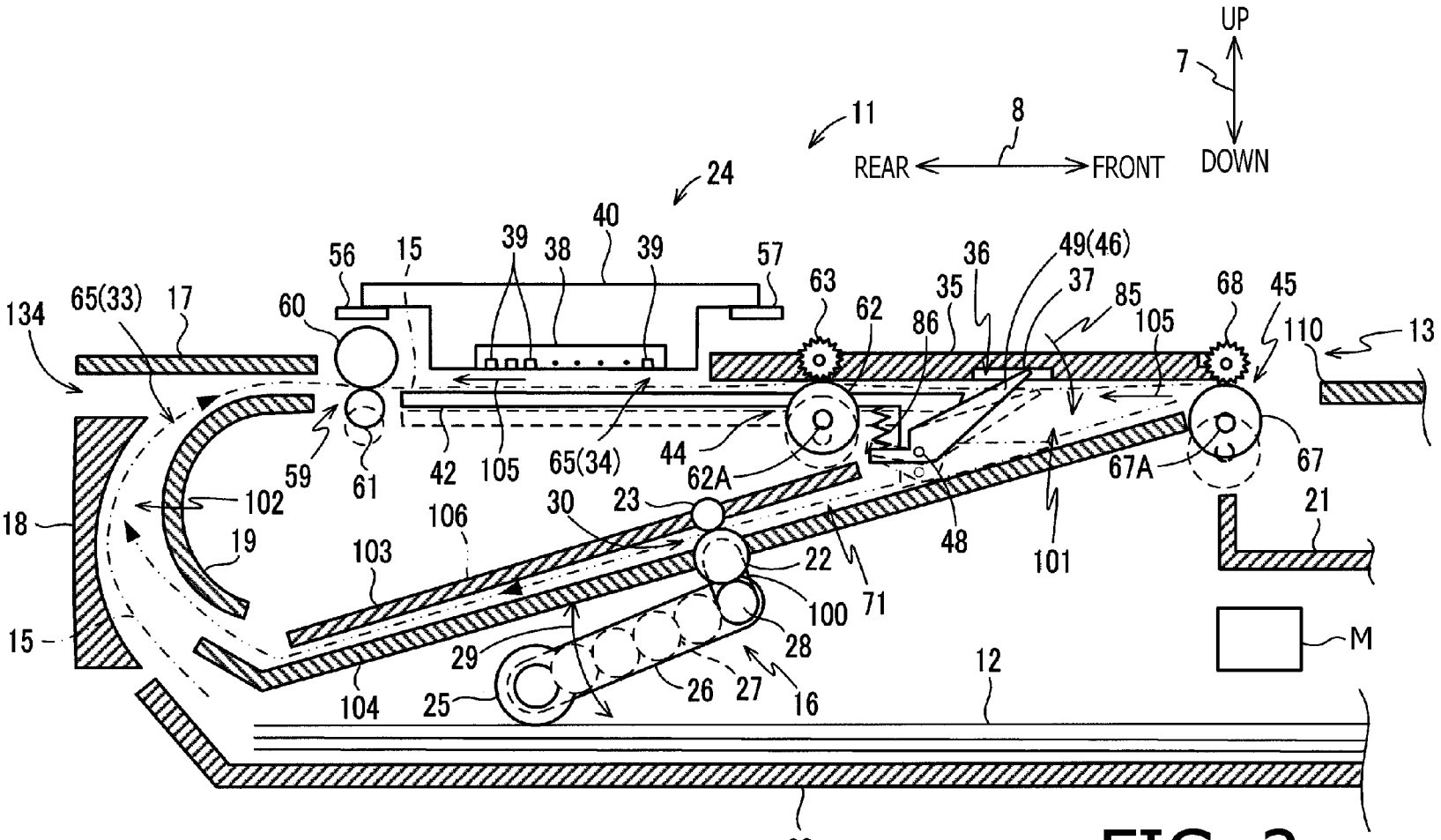
FIG. 2 is a cross-sectional side view of an internal structure of a printer 11 in the MFD 10 according to the embodiment of the present disclosure.

The MFD 10 is further equipped with a recording function to record an image on a disk surface of recording medium (not shown), such as a CD-ROM and a DVD-ROM, which may be supported on a medium tray 110 (see FIG. 2). The medium tray 110 is a flat resin plate, which is formed to have a round-shaped and downward dent on an upper side and at a widthwise central area thereof, so that the recording medium may be set in the dent. A thickness of the medium tray 110 may be greater than a thickness of the recording sheet 12.

The printer 11 includes a chassis 14. On a front face 75 of the chassis 14, formed is the opening 13. As shown in FIG. 2, the chassis 14 includes a first conveyer path 65 and a second conveyer path 71, which will be described later in detail. The chassis 14 includes an exterior cover, which may accommodate parts and components for the printer 11 therein.

The MFD 10 further includes a conveyer device. The conveyer device includes the chassis 14, parts and members that form the first conveyer path 65, a flapper 49, a coil spring 86, a movable member 90, and a conveyer motor M, each of which will be described later in detail.

[Feeder Tray 20]

As depicted in FIG. 1, a feeder tray 20 is installable in and removable from the chassis 14 through a lower area of the opening 13. As depicted in FIG. 2, the recording sheet 12 may be stored in and supported by the feeder tray 20. A sheet ejection tray 21 may be supported at an upper position in the feeder tray 20. On an upper plane of the sheet ejection tray 12, the recording sheet 12 with images formed thereon may be placed.

[Feeder Unit 16]

As depicted in FIG. 2, a feeder unit 16 is arranged in an upper position with respect to the feeder tray 20 in the chassis 14. The feeder unit 16 includes a feeder roller 25, a feeder arm 26, a drive-force transmission system 27, and a support shaft 28. The feeder roller 25 is rotatably supported at one longitudinal end of the feeder arm 26. The feeder arm 26 is pivotable about the support shaft 28, which is on the other longitudinal end thereof, in directions indicated by an arrow 29. Thus, the feeder roller 25 is movable to be closer to or farther from the recording sheet 12 placed on the feeder tray 20.

The feeder roller 25 is rotatable by a driving force generated in the conveyer motor M and transmitted through the drive-force transmission system 27, in which a plurality of gears are meshed with one another. Thereby, an uppermost recording sheet 12 that contacts the feeder roller 25 among a plurality of recording sheets 12 supported on the feeder tray 20 may be fed to the first conveyer path 65. The feeder roller 25 may, but not necessarily, be rotatable by a driving force generated in a motor which is different from the above-mentioned conveyer motor M.

[First Conveyer Path 65]

As depicted in FIG. 2, the first conveyer path 65 is formed in the chassis 14 to extend from a rearward end of the feeder tray 20. The first conveyer path 65 includes a curved path 33 and a linear path 34. The curved path 33 is formed to curve upward from the rearward end of the feeder tray 20 and is connected with the linear path 34 at a rearward position with respect to a conveyer roller pair 59, which will be described later in detail. The linear path 34 is formed to extend from an aperture 134, which is formed on the rear side of the printer 11, to a reversible roller pair 45, which will be described later in detail. In this regard, however, the aperture 134 may not necessarily be formed but may be omitted. If the aperture 134 is omitted, the linear path 34 may extend from an upper end of the curved path 33 to the reversible roller pair 45 along the front-rear direction 8.

A form of the curved path 33 is defined by an outer guide member 18 and an inner guide member 19, which are spaced apart from each other for a predetermined amount of clearance to face each other along the front-rear direction 8. The linear path 34 is formed at a position corresponding to the recording unit 24, and a form of a part of the linear path 34 is defined by the recording unit 24 and a platen 42, which are spaced apart from each other for a predetermined amount of clearance to face each other along the vertical direction 7. Further, at a rearward area with respect to the recording unit 24, a form of another part of the linear path 34 is defined by a first upper guide member 17 and the outer guide member 18, which are spaced apart from each other for a predetermined amount of clearance to face each other, and by a conveyer roller 60 and a pinch roller 61, which are arranged to face each other. Further, at a frontward area with respect to the recording unit 24, a form of another part of the linear path 34 is defined by a second upper guide member 35, the platen 42, an ejection roller 62, a spur roller 63, the flapper 49, a reversible roller 67, and a spur roller 68. A part of the second upper guide member 35 and the platen 42 are paired to face with each other, the ejection roller 62 and the spur roller 63 are paired to face with each other, another part of the second upper guide member 35 and the flapper 49 are paired to face with each other, and the reversible roller 67 and the spur roller 68 are paired to face with each other. The second upper guide member 35 and the platen 42, and the second upper guide member 35 and the flapper 49 are respectively arranged to be spaced apart from each other. Thus, the above-described mutually opposing and facing members form at least a part of the first conveyer path 65.

The recording sheets 12 placed on the feeder tray 20 are fed by the feeder roller 25 to the curved path 33 and conveyed through the curved path 33 and the linear path 34 along a conveying direction 15, which is indicated by a dotted line in FIG. 2. The medium tray 110 may be inserted in the linear path 34 through the opening 13 and conveyed along the front-rear direction 8, i.e., in the conveying direction 15 or a reverse direction 105 being opposite from the conveying direction, to carry the recording medium placed thereon.

[Recording Unit 24]

As depicted in FIGS. 2 and 3, the recording unit 24 is disposed along the linear path 34, in an upper position with respect to the linear path 34. In a lower position with respect to the linear path 34, and in a position to face with the recording unit 24 vertically, disposed is the platen 42, which supports the recording sheet 12 in the first conveyer path 65.

The recording unit 24 includes a carriage 40 and a recording head 38. The carriage 23 is movable in the widthwise direction 9 on the guide rails 56, 57 (see FIG. 7), which are arranged to be spaced apart from each other along the front-rear direction 8. The guide rails 56, 57 are supported by a pair of lateral frames 53 at widthwise ends thereof. The pair of lateral frames 53 are arranged on rightward and leftward positions of the linear path 34, and each of the lateral frames 53 includes a bottom plate 54 and a lateral plate 55 which stands upward at an outer edge of the bottom plate 54.

As depicted in FIGS. 2 and 3, the recording head 38 is mounted on the carriage 40. On a bottom plane of the recording head 38, formed are a plurality of nozzles 39. As ink is supplied to the recording head 38 from an ink cartridge (not shown), and the carriage 40 moves in the widthwise direction 9, the recording head 38 discharges ink droplets at the platen 42. Thus, an image is formed in the ink on the recording sheet 12 supported on the platen 42 or the recording medium supported and carried on the medium tray 110.

The platen 42 is supported at frontward and rearward positions by the lateral frames 53. As depicted in FIG. 8, the platen 42 includes a plurality of upper claws 31 and lower claws 32, which are arranged to be spaced apart from one another along the widthwise direction 9 to protrude frontward from a front edge of the platen 42. The ejection roller 62, which will be described later in detail, is disposed between the upper claws 31 and the lower claws 32. In this regard, by placing the upper claws 31 and the lower claws 32 to contact a shaft 62A of the ejection roller 62, the platen 42 is supported by the ejection roller 62. Meanwhile, the ejection roller 62 is supported by the lateral frames 53. Therefore, the platen 42 is supported at the front side by the lateral frames 53 through the ejection roller 62. On the rear side of the platen 42, a contact piece 73 accompanied with by a coil spring 72 is arranged on a lower face at each widthwise end of the platen 42. The contact pieces 73 are supported on a movable member 90, which will be described later in detail, and the movable member 90 is supported by the lateral frames 53. Therefore, the platen 42 is supported at the rear side by the lateral frames 53 through the movable member 90.

[Conveyer Roller Pair 59, Ejection Roller Pair 44, and Reversible Roller Pair 45]

As depicted in FIGS. 2 and 3, the conveyer roller pair 59 is disposed at a position in the linear path 34 on an upstream side of the recording unit 24 with regard to the conveying direction 15. The ejection roller pair 44 is disposed at a position in the linear path 34 on the downstream side of the recording unit 24 with regard to the conveying direction 15. The reversible roller pair 45 is disposed at a position in the linear path 34 on a downstream side of the ejection roller pair 44 with regard to the conveying direction 15.

The conveyer roller pair 59 includes the above-mentioned conveyer roller 60, which is disposed on an upper side of the linear path 34, and a pinch roller 61, which is disposed on a lower side of the linear path 34 to face with the conveyer roller 60. The ejection roller pair 44 includes an ejection roller 62, which is disposed on the lower side of the linear path 34, and a spur roller 63, which is disposed on the upper side of the linear path 34 to face with the ejection roller 62. The reversible roller pair 45 includes the reversible roller 67, which is disposed on the lower side of the linear path 34, and the spur roller 68, which is disposed on the upper side of the linear path 34 to face with the reversible roller 67.

The pinch roller 61 is urged toward the conveyer roller 60 by a third coil spring 66. The ejection roller 62 is urged toward the spur roller 63 by a second coil spring 94. The reversible roller 67 is urged toward the spur roller 68 by a first coil spring 92. Thus, the conveyer roller pair 59 and the ejection roller pair 44 can nip the recording sheet 12 or the medium tray 110 in the first conveyer path 65, while the reversible roller pair 45 can nip the recording sheet 12 in the first conveyer path 65.

As depicted in FIGS. 3A-3B and 4, the pinch roller 61 disposed at the lower side within the conveyer roller pair 59 is rotatably supported by a roller holder 64. The roller holder 64 is supported by a third upper guide member 103, which will be described later in detail, through the third coil spring 66. In other words, the third coil spring 66 is interposed between the roller holder 64 and the third upper guide member 103. An upper face of the third upper guide member 103 is formed in two-leveled surfaces (not shown), which are continuous with each other through a slanted surface (not shown). As the third upper guide member 103 moves in the front-rear direction 8, the levels of the surfaces that supports the roller holder 64 are switched. Thereby, the roller holder 64 and the pinch roller 61 are vertically movable.

Widthwise ends of the ejection roller 62 and the reversible roller 67, which are on the lower side within the ejection roller pair 44 and the reversible roller pair 45 respectively, are inserted in vertically elongated-shaped openings (not shown) formed in the lateral frames 53 so that the ejection roller 62 and the reversible roller 67 are vertically movably supported by the lateral frames 53 to be movable along the elongated shape.

As the pinch roller 61, the ejection roller 62, and the reversible roller 67 move vertically, the conveyer roller pair 59, the ejection roller pair 44, and the reversible roller pair 45 respectively shift between a contact condition and a separated condition. In the contact condition, the paired rollers, which are the conveyer roller 60 and pinch roller 61, the ejection roller 62 and the spur roller 63, the reversible roller 67 and spur roller 68, contact each other within the conveyer roller pair 59, the ejection roller pair 44, and the reversible roller pair 45 respectively; and in the separated condition, the paired rollers 60 and 61, 62 and 63, 67 and 68 are separated from each other within the conveyer roller pair 59, the ejection roller pair 44, and the reversible roller pair 45 respectively. The conveyer roller pair 59, the ejection roller pair 44, and the reversible roller pair 45 in the contact condition may nip and convey the recording sheet 12. The conveyer roller pair 59 and the ejection roller pair 44 in the separated condition may nip and convey the medium tray 110. In this regard, due to a reason that the reversible roller 67 moves for a larger amount to a lower position than the pinch roller 61 or the ejection roller 62 when the reversible roller pair 45 shifts from the contact condition to the separated condition, the reversible roller pair 45 in the separated condition may not nip or convey the medium tray 110. Meanwhile, the reversible roller pair 45 may be configured to nip and convey the medium tray 110 in the separated condition.

The conveyer roller 60, the ejection roller 62, and the reversible roller 67 may be rotated in a normal rotating direction by the driving force from the conveyer motor M rotating in the normal rotation and in a reverse rotating direction by the driving force from the conveyer motor M rotating in the reverse direction. The pinch roller 61, the spur roller 63, and the spur roller 68 are rotated by the rotation of the conveyer roller 60, the ejection roller 62, and the reversible roller 67, respectively.

While the recording sheet 12 or the medium tray 110 is nipped by the conveyer roller pair 59, the ejection roller pair 44, and the reversible roller pair 45, when the conveyer roller 60, the ejection roller 62, and the reversible roller 67 rotate in the normal rotating direction, the recording sheet 12 or the medium tray 110 being nipped is conveyed in the conveying direction 15. On the other hand, when the conveyer roller 60, the ejection roller 62, and the reversible roller 67 rotate in the reverse rotating direction, the recording sheet 12 or the medium tray 110 being nipped is conveyed in the reverse direction 105 being opposite from the conveying direction 15.

[Second Conveyer Path 71]

As depicted in FIG. 2, the second conveyer path 71 is formed in a lower position with respect to the linear path 34 and an upper position with respect to the feeder roller 25. The second conveyer path 71 is branched from the linear path 34 at a branch point 101, which is on the downstream side of the ejection roller pair 44 and on the upstream side of the reversible roller pair 45 with regard to the conveying direction 15. In other words, the linear path 34 and the second conveyer path 71 are jointed at the branch point 101. The second conveyer path 71 branched from the first conveyer path 65 is merged with the curved path 33 at a merging point 102, which is on the upstream side of the conveyer roller pair 59 with regard to the conveying direction 15. A form of a part of the second conveyer path 71 is defined by the third upper guide member 103 and the lower guide member 104, which are arranged to be spaced apart from each other for a predetermined amount of clearance to face each other across the clearance.

[Return-Conveyer Roller Pair 30]

As depicted in FIG. 2, a return-conveyer roller pair 30 is disposed in the second conveyer path 71. The return-conveyer roller pair 30 includes a return-conveyer roller 22, which is disposed on a lower side of the second conveyer path 71, and a driven roller 23, which is disposed on an upper side of the second conveyer path 71 to face with the return-conveyer roller 22. The return-conveyer roller 22 is rotatably supported at a longitudinal end of the return-conveyer arm 100 and is driven to rotate by the conveyer motor M. The driven roller 23 is rotated by the rotation of the return-conveyer roller 22. The return-conveyer roller 22 is rotated in a normal rotating direction by the driving force from the conveyer motor M rotating in either the normal or reverse direction. While the recording sheet 12 is nipped by the return-conveyer roller pair 30, when the return-conveyer roller 22 rotates in the normal rotating direction, the recording sheet 12 nipped by the return-conveyer roller pair 30 is conveyed in the second conveyer path 71 in an inverting direction 106, which is indicated by a double-dotted arrow in FIG. 2, oriented from the branch point 101 toward the merging point 102.

[Flapper 49]

As depicted in FIG. 2, the flapper 49 is disposed in the linear path 34 between the ejection roller pair 44 and the reversible roller pair 45. The flapper 49 is disposed, in particular, at the branch point 101, where the second conveyer path 71 is branched from the first conveyer path 65. The flapper 49 may be arranged to face with the second upper guide member 35 along the vertical direction 7.

The flapper 49 is pivotable to shift among a first condition, a second condition, and a third condition. In the first condition, the flapper 49 is placed to contact the second upper guide member 35 and block the first conveyer path 65, as indicated by solid lines in FIG. 2 and FIG. 3A. In the second condition, the flapper 49 is placed in a lower position than the first condition to allow the recording sheet 12 being conveyed in the conveying direction 15 to pass thereby, as indicated by broken lines in FIG. 2 and solid lines in FIG. 3B. In the third condition, the flapper 49 is arranged to be a lower position than the second condition to allow the medium tray 110 being conveyed in the conveying direction 15 or the reverse direction 105, as indicated by chain-and-dot lines in FIG. 2 and solid lines in FIG. 4. Thus, the flapper 49 in the second and third conditions is separated from the second upper guide member 35.

As depicted in FIG. 8, the flapper 49 includes a plurality of leaf members 46, connecting members 47, first projections 48, and second projections 50. The plurality of leaf members 46, each of which is formed to be smaller in a dimension in the widthwise direction 9 than dimensions in the vertical direction 7 and the front-rear direction 8, are arranged to be spaced apart from one another along the widthwise direction 9. The connecting members 47 connect adjoining leaf members 46 with one another. The first projections 48 and the second projections 50 are arranged to protrude outward in the widthwise direction 9 from the leaf members 46 at widthwise ends. The leaf members 46, the connecting members 47, the first projections 48, and the second projections 50 may be formed integrally with one another or may be formed separately and assembled together.

The flapper 49 is pivotaly supported by the platen 42. As depicted in FIG. 8, among the plurality of lower claws 32 in the platen 42, the lower claws 32 at a rightward end and a leftward end are arranged on a rightward side and a leftward side of the flapper 49 so that the flapper 49 may be interposed between the rightward and leftward lower claws 32. On a widthwise inner side of each of the rightward and leftward lower claws 32, formed is a dent 41, which dents outward along the widthwise direction 9. The first projections 48 in the flapper 49 are inserted rotatably in the dents 41 so that the flapper 49 is pivotably supported by the flapper 49 to pivot about the first projections 48.

As depicted in FIG. 2, the flapper 49 is urged upward by the coil spring 86, one end of which is connected to the flapper 49. The other end of the coil spring 86 is connected to the platen 49. While the flapper 49 is urged by the coil spring 86, front ends 37 of the leaf members 46 in the flapper 49 in the first condition contact a lower surface of the second upper guide 35. In particular, the front ends 37 of the leaf members 46 may contact a downward surface of a dent 36 formed on the lower side of the second upper guide member 35. Thus, the coil spring 86 urges the flapper 49 to tend toward the first condition.

The flapper 49 is, while no force except the urging force from the coil spring 86 is applied to the flapper 49, placed in the first condition (see FIG. 3A) by the coil spring 86. When an image is formed in the recording unit 24 on a first side of the recording sheet 12, and when the recording sheet 12 conveyed in the linear path 34 by the ejection roller pair 44 in the conveying direction 15 contacts upper edges 51 of the leaf members 46 in the flapper 49, the front ends 37 of the flapper 49 are pressed to be lower against the urging force of the coil spring 86 by the recording sheet 12 being conveyed, and the flapper 49 is pivoted to be placed in the second condition (see FIG. 3B). In this regard, a virtual plane spreading on the upper edges 51 of the leaf members 46 guides the recording sheet 12. In other words, the recording sheet 12 is guided on the virtual plane spreading on the upper edges 51 of the leaf members 46. In the meantime, while the recording sheet 15 is conveyed in the conveying direction 15, the conveyer roller 60, the ejection roller 62, the reversible roller 67, and the return-conveyer roller 22 rotate in the normal rotating direction.

Thereafter, as a tail end of the recording sheet 12 conveyed in the conveying direction 15 by the reversible roller 67 passes through the flapper 49, the flapper 49 being urged by the coil spring 86 is released from the pressure of the recording sheet 12 and pivots to shift from the second condition to the first condition.

If the reversible roller 67 continues to rotate in the normal rotating direction, the reversible roller pair 45 conveys the recording sheet 12 in the conveying direction 15 to eject the recording sheet 12 in the ejection tray 21. Meanwhile, if the direction of the rotation of the reversible roller 67 is switched from the normal rotating direction to the reverse rotating direction, the reversible roller pair 45 conveys the recording sheet 12 in the inverting direction 106. In this regard, the flapper 49 is back in the first condition to block the first conveyer path 65; therefore, the recording sheet 12 does not return to the first conveyer path 65 but is guided along lower edges 52 of the flapper 49 to the second conveyer path 71. Thus, the flapper 49 in the first condition guides the recording sheet 12, which is conveyed by the reversible roller pair 45 rotating in the reverse direction 105. As the directions to convey the recording sheet 12 switch, the former tail end (i.e., a rearward end) of the recording sheet 12 on the rear side now becomes a leading end, and the former leading end (i.e., a frontward end) of the recording sheet 12 on the front side now becomes a tail end in the second conveyer path 71. Thus, with the leading end on the rear side, when the recording sheet 12 is conveyed through the second conveyer path 71 and reenters the first conveyer path 65, the recording sheet 12 is inverted upside-down. When the direction of rotation of the reversible roller 67 is switched from the normal rotating direction to the reverse rotating direction, the direction of rotation of the conveyer roller 60 and the ejection roller 62 is switched from the normal rotating direction to the reverse rotating direction, while the direction of rotation of the return-conveyer roller 22 is maintained in the normal rotating direction.

The recording sheet 12 guided to the second conveyer path 71 is conveyed further by the return-conveyer roller pair 30 in the inverting direction 106, and through the merging point 102, into the curved path 33 in the conveying direction 15. As the recording sheet 12 conveyed in the curved path 33 reaches the conveyer roller pair 59, the direction of rotation of the conveyer roller 60, the ejection roller 62, and the reversible roller 67 is switched from the reverse rotating direction to the normal rotating direction. In this regard, however, the direction of rotation of the reverse-conveyer roller 22 is not switched but maintained in the normal rotating direction. Accordingly, the recording sheet 12 is conveyed by the conveyer roller pair 59 in the conveying direction 15 to reach the position below the recording unit 24. When the recording sheet 12 reaches the position below the recording unit 24, a second side of the recording sheet 12 faces with the recording unit 24 along the vertical direction 7 so that the recording unit 24 may record an image on the second side of the recording sheet 12. Thereafter, the recording sheet 12 with the images formed on the both sides thereof is conveyed by the ejection roller pair 44 and the reversible roller pair 45 to be ejected in the ejection tray 21. Thus, the recording sheet 12 may be inverted in the second conveyer path 71 and the first conveyer path 65 so that the recording sheet 12 may be conveyed in the inverting direction 106 to be directed to the first conveyer path 65 once again.

The flapper 49 may be pivoted to shift to the third condition by the movable member 90, which will be described below. In the third condition, the upper edges 51 of the leaf members 46 in the flapper 49 align substantially along the front-rear direction 8 and define a form of a part of the first conveyer path 65.

[Movable Member 90]

The printer 11 includes, as depicted in FIGS. 5 and 6, a movable member 90. The movable member 90 includes a pair of pieces, which are movable along the conveying direction 15 in the front-rear direction 8. The paired pieces of the movable member 90 are arranged to be spaced apart from each other with regard to the widthwise direction 9, which intersects with the conveying direction 15, on widthwise outside of the first conveyer path 65. In other words, the paired pieces of movable member 90 are arranged to flank the flapper 49 disposed in the first conveyer path 65, and the flapper 49 is interposed between the paired pieces of the movable member 90. Therefore, the second projections 50 protruding outward from the widthwise ends of the flapper 49 protrude toward each piece of the movable member 90. Each piece of the movable member 90 is supported by the bottom plate 54 of the lateral frame 53.

The movable member 90 is movable between a first position (see FIGS. 3A-3B and 5) and a second position (FIGS. 4A-4B and 6), which are different positions along the front-rear direction 8. In particular, the first position is a rearward position with respect to the second position, and the second position is a frontward position with respect to the first position.

As depicted in FIG. 9, each piece of the movable member 90 has a shape of a bar elongated in the front-rear direction 9. FIG. 9 shows one of the paired pieces of movable member 90 on the right, which is disposed rightward with respect to the first conveyer path 65.

The movable member 90 is formed to have a handle 91 at a frontend thereof. The handle 91 is exposed outside the MFD 10 through the opening 13 to be held by a user. As the user moves the movable member 90 in the front-rear direction 8 through the handle 91, the movable member 90 slidably moves between the first position and the second position. In this regard, the direction for the movable member 90 to slidably move may not necessarily be limited to the front-rear direction 8 but may be, for example, an angled direction with respect to the front-rear direction 8.

Each piece of the movable member 90 includes a first coil spring 92, a first contact piece 93, a second coil spring 94, and a second contact piece 95. Further, each piece of the movable member 90 is formed to have a first slanted surface 96, a first flat surface 97, a second slanted surface 98, a second flat surface 99, a third slanted surface 76, a third flat surface 77, a fourth slanted surface 78, an anterior flat surface 79, a posterior flat surface 80, and a dent 81. The first through fourth slanted surfaces 96, 98, 76, 78 incline to be higher at the downstream side than the upstream side with regard to the conveying direction 15.

The first contact piece 93 is attached to an upper face of each piece of the movable member 90 through the first coil spring 92 in a rearward position with respect to the handle 91. The first slanted surface 96 is formed in a rearward position with respect to the first contact piece 93 to be continuous with an upper surface of the first contact piece 93. The first flat surface 97 is formed in a rearward position with respect to the first slanted surface 96 continuously with the first slanted surface 96.

The second contact piece 95 is attached to an upper face of the movable member 90 through the second coil spring 94 in a rearward position with respect to the first flat surface 97. The second slanted surface 98 is formed in a rearward position with respect to the second contact piece 95 to be continuous with an upper surface of the second contact piece 95. The second flat surface 99 is formed in a rearward position with respect to the second slanted surface 98 continuously with the second slanted surface 98.

The third slanted surface 76 and the third flat surface 77 are formed in a protrusive section 83, which is formed in a position between the first flat surface 97 and a second contact piece 95 in each piece of the movable member 90. The protrusive section 83 is formed to bend rearward, and the third slanted surface 76 and the third flat surface 77 are formed on a lower side of the rearward bended part in the protrusive section 83. The third flat surface 77 is formed in a rearward position with respect to the third slanted surface 76 continuously with the third slanted surface 76.

The anterior flat surface 79 is formed in a rearward position with respect to the second flat surface 99 and a frontward position with respect to the fourth slanted surface 78. The fourth slanted surface 78 is formed in a rearward position with respect to the anterior flat surface 79 continuously with the anterior flat surface 79. The posterior flat surface 80 is formed in a rearward position with respect to the fourth slanted surface 78 continuously with the fourth slanted surface 78.

The dent 81 is formed in a rearward position with respect to the posterior flat surface 80 and at a rear end of each piece of the movable member 90. The dent 81 is coupled with the third upper guide member 103. In particular, the third upper guide member 103 has projections (not shown), which protrude outward in the widthwise direction 9 from widthwise ends of the third upper guide member 103, and the projections are set in the dents 81.

[Movement of the Movable Member 90]

Behaviors and conditions of the pinch roller 61, the ejection roller 62, the reversible roller 67, the platen 42, and the flapper 49 according to movement of the movable member 90 will be described below.

First, a condition of the pinch roller 61, the ejection roller 62, the reversible roller 67, the platen 42, and the flapper 49 when the movable member 90 is in the first position (see FIGS. 3A-3B and 5) will be described. As depicted in FIG. 5, when the movable member 90 is in the first position, the first contact pieces 93 support a shaft 67A of the reversible roller 67, and the second contact pieces 95 support a shaft 62A of the ejection roller 62. In this regard, the reversible roller 67 is urged upward by the first coil springs 92, and the ejection roller 62 is urged upward by the second coil springs 94. Therefore, the shafts 67A, 62A of the reversible roller 67 and the ejection roller 62 respectively are urged against inner upper edges of the elongated openings, which are formed in the lateral frames 53. Thus, the reversible roller 67 and the ejection roller 62 are placed in predetermined correct positions. In the meantime, as depicted in FIGS. 3A-3B, the reversible roller 67 and the ejection roller 62 in the predetermined correct positions are placed to contact the spur rollers 68, 63 respectively.

When the movable member 90 is in the first position, further, the roller holder 64 is placed to contact, through the third coil spring 66, the higher surface between the two-leveled surfaces formed on the upper face of the third upper guide member 103 at a lower surface thereof. In particular, the third upper guide member 103 is formed to have a hole (not shown). Meanwhile, the roller holder 64 is formed to have a projection (not shown), which protrude downward from a lower surface thereof. The projection of the roller holder 64 is inserted in the hole formed in the third upper guide member 103 to be in contact with the higher surface of the third upper guide member 103. Thereby, the pinch roller 64 held by the roller holder 64 is urged upward by the third coil spring 66 to contact the conveyer roller 60. Meanwhile, the third upper guide member 103 is formed to have a plurality of ribs (not shown), which are formed to protrude downward and elongated along the inverting direction 106, on a lower side thereof. A downward protrusive amount of the ribs is greater than a downward protrusive amount of the projection formed on the lower surface of the roller holder 64. Therefore, the recording sheet 12 conveyed in the second conveyer path 71 may be prevented from colliding with the roller holder 64.

Meanwhile, as depicted in FIG. 5, when the movable member 90 is in the first position, the platen 42 being urged upward by the coil springs 72 is in an arrangement such that the lower claws 32 formed at the front end of the platen 42 contact the ejection roller 62 from below (see also FIG. 8). In this regard, as described above, the ejection roller 62 is placed in the predetermined correct position. Meanwhile, the anterior flat surfaces 79 in the movable member 90 support the contact pieces 73 in the platen 42. In this regard, a projection 74 (see FIG. 8) formed in the platen 42 at a rearward position with respect to each coil spring 72 is urged against the coil spring 72 in a compressed condition. Thereby, the projection 74 is urged against a protrusive edge 82 (see FIG. 7), which is formed to protrude from one of the lateral frames 53 toward the other of the lateral frames 53. Thus, the rear side of the platen 42 is aligned with a predetermined correct position.

Further, when the movable member 90 is in the first position, the flapper 49 is in the first condition, in which the flapper 49 contacts the downward surface of the dent 36 formed on the lower side of the second upper guide member 35 to block the first conveyer path 65. As depicted in FIG. 5, the second projections 50 protruding outward from the widthwise ends of the flapper 49 are inserted in openings 84, which are formed in the movable member 90. The opening 84 is, as depicted in FIG. 9, formed in the protrusive section 83 in each piece of the movable member 90, and an outline of which is defined by an upper rim of the movable member 90 and the rearward bended part in the protrusive section 83. When the movable member 90 is in the first position, the second projections 50 are not in contact with the surfaces that form the outline of the openings 84 (e.g., the third slanted surface 76 or the third flat surface 77) and float in the openings 84. In other words, the flapper 49, including the second projections 50, is contactless from the movable member 90 when the movable member 90 is in the first condition.

Next, a condition of the pinch roller 61, the ejection roller 62, the reversible roller 67, the platen 42, and the flapper 49 when the movable member 90 is shifted from the first position to the second position will be described with reference to FIGS. 3A-3B, 6, and 9.

As the movable member 90 is moved from the first position to the second position, the first contact pieces 93 are separated from the shaft 67A of the reversible roller 67. Therefore, the reversible roller 67 is released from the urging force from the first coil springs 92. Thereafter, the shaft 67A contacts the first slanted surfaces 96 and the first flat surfaces 97 sequentially. In this sequence, the shaft 67A is guided downward along the first slanted surfaces 96. When the movable member 90 reaches the second position, the shaft 67A is supported by the first flat surfaces 97. Meanwhile, the reversible roller 67 is separated from the spur roller 68.

As the movable member 90 moves from the first position to the second position, further, the second contact pieces 95 are separated from the shaft 62A of the ejection roller 62. Therefore, the ejection roller 62 is released from the urging force from the second coil springs 94. Thereafter, the shaft 62A contacts the second slanted surfaces 98 and the second flat surfaces 99 sequentially. In this sequence, the shaft 62A is guided downward along the second slanted surfaces 98. When the movable member 90 reaches the second position, the shaft 62A is supported by the second flat surfaces 99. Meanwhile, the ejection roller 62 is separated from the spur roller 63.

Further, as the movable member 90 moves from the first position to the second position, the third upper guide member 103 coupled with the movable member 90 at the dents 81 is moved frontward along with the movable member 90. Therefore, the roller holder 64 being in contact with the higher surface on the lower face of the third upper guide member 103 shifts to contact the lower surface on the lower face of the third upper guide member 103. Accordingly, the pinch roller 61 is moved downward. Thus, when the movable member 90 reaches the second position, the pinch roller 61 is separated from the conveyer roller 60.

As the movable member 90 moves from the first position to the second position, the ejection roller 62 moves downward, and the lower claws 32 on the front side of the platen 42 are moved downward by the ejection roller 62. Thereby, the front side of the platen 42 is moved downward. Meanwhile, the anterior flat surfaces 79 are separated from the contact pieces 73 on the platen 42. Thereafter, the contact pieces 73 contact the fourth slanted surfaces 78 and the posterior flat surfaces 80 sequentially. In this sequence, the rear side of the platen 42 is moved downward, and the coil springs 72 having been in the compression condition restore to a natural condition. Accordingly, the projections 74 on the platen 42 are separated from the protrusive edges 82 of the lateral frames 53. Thereafter, the movable member 90 reaches the second position. While the movable member 90 is in the second position, a distance between the platen 42 and the recording unit 24 in the vertical direction 7 is greater than the distance between the platen 42 and the recording unit 24 in the vertical direction 7 when the movable member 90 is in the first position. When the movable member 90 is in the second position, the coil springs 72 are in the natural condition; therefore, the paten 42 is supported by the ejection roller 62 through the upper claws 31 contacting the shaft 62A of the ejection roller 62 from above. At the same time, the platen 42 is supported by the movable member 90 through the contact pieces 73 contacting the posterior flat surfaces 80.

As the movable member 90 moves from the first position to the second position, the platen 42 moves downward, and the first projections 48 in the flapper 49 inserted in the dents 41 are pushed downward by upper rims of the dents 41. Thereby, the flapper 49 is moved downward. Further, the second projections 50 in the flapper 49 contact the third slanted surfaces 76 and the third flat surfaces 77 in the movable member 90 sequentially. In this sequence, the second projections 50 are guided along the third slanted surfaces 76 to move downward. Accordingly, the flapper 49 pivots about the first projections 48 in the direction indicated by the arrow 85 (see FIG. 2). Thus, when the movable member 90 moves to the second position, the flapper 49 moves downward and pivots in the direction indicated by the arrow 85. That is, the flapper 49 is shifted from the first condition to the third condition.

Thus, the second projections 50 move the flapper 49 to pivot to the third condition by contacting the movable member 90, which moves from the first position to the second position. In other words, the third slanted surfaces 76 contact the second projections 50, while the movable member 90 is in the sequence to move from the first position to the second position, to cause the flapper 49 to pivot from the first condition to the third condition. When the movable member 90 is in the second position, the first projections 48 in the flapper 49 is retained downward by the upper ridges of the dents 41 from above. Further, the second projections 50 in the flapper 49 are retained downward by the third flat surfaces 77 from above. Thus, when the movable member 90 is in the second position, the flapper 49 is maintained in the third condition.

On the other hand, when the movable member 90 moves from the second position to the first position, the movement of each part described above is reversed. Therefore, the reversible roller 67 moves upward with the shaft 67A being guided along the first slanted surfaces 96 to contact the spur roller 68. The ejection roller 62 with the shaft 62A being guided along the second slanted surfaces 98 moves upward to contact the spur roller 63. The roller holder 64 supported by the higher surface of the third upper guide member 103 shifts to be supported by the lower surface of the third upper guide member 103 as the third upper guide member 103 moves rearward. Thereby, the pinch roller 61 supported by the roller holder 64 moves upward to contact the conveyer roller 60.

Meanwhile, the platen 42 moves upward as the ejection roller 62 moves upward and the contact pieces 73 are guided along the fourth slanted surfaces 78. Thereby, the platen 42 is placed to be closer to the recording unit 24, and the distance between the platen 42 and the recording unit 24 in the vertical direction 7 is reduced. The flapper 49 moves upward along with the platen 42 and, by being guided along the third slanted surfaces 76, pivots in the direction opposite from the arrow 85. Thus, the flapper 49 shifts from the third condition to the first condition.

Effects

According to the embodiment described above, by moving the movable member 90 from the first position to the second position, the flapper 49 is separated from the second upper guide 35; the rollers 60 and 61, 62 and 63, 67 and 68 in the conveyer roller pair 59, the ejection roller pair 44, and the reversible roller pair 45 are separated; and the distance between the platen 42 and the recording unit 24 is enlarged. Accordingly, sheet jam occurred in the first conveyer path 65 may be easily resolved. Further, according to the embodiment, the movable member 90 in the first position is separated to be contactless from the flapper 49 in the first condition; therefore, external force is not applied to the flapper 49 through the movable member 90 in the first position. Meanwhile, the flapper 49 in the first condition contacts the downward surface of the dent 36 formed on the lower side of the second upper guide member 35. Therefore, posture of the flapper 49 in the first condition may be stabilized. In the meantime, however, when the movable member 90 moves from the first position to the second position, the separation may not necessarily be caused in each of the flapper 49, the pinch roller 61, the ejection roller 62, the reversible roller 67, and the platen 42 from the second upper guide member 35, the conveyer roller 60, the spur roller 63, the spur roller 68, and the recording unit 24, respectively, but may be caused in one or some of these separable members that form the conveyer path 65. Further, the movement of the movable member 90 may cause separation in other members that form the conveyer path 65.

According to the embodiment described above, when the movable member 90 is moved from the first position to the second position, the flapper 49 contacted by the movable member 90 is moved by the contact to pivot in the direction to be separated from the second upper guide member 35 and is moved along with the platen 42 to be further separated from the second upper guide member 35. Therefore, the first conveyer path 65 may be further enlarged in the vertical direction 7 so that the sheet jam occurred in the first conveyer path 65 may be cleared more easily.

According to the embodiment described above, the nipped condition in the conveyer roller pair 59, the ejection roller pair 44, and the reversible roller pair 45 may be cleared easily; therefore, the sheet jam occurred in the first conveyer path 65 may be cleared easily.

According to the embodiment described above, while the flapper 49 is placed in the third condition, the medium tray 110 may be conveyed in the first conveyer path 65 smoothly without being interfered with by the flapper 49.

According to the embodiment described above, the movable member 90 may move the flapper 49 to pivot through the third slanted surface 76 and support the second projections 50 in the flapper 49 through the third flat surfaces 77. Therefore, the movable member 90 may be moved linearly along the first conveyer path 65. Accordingly, the internal structure in the MFD 10 may be simplified, and an easy operation through the movable member 90 may be provided.

Modified Examples

Although an example of carrying out the invention has been described, those skilled in the art will appreciate that there are numerous variations and permutations of the conveyer and the image recording apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the flapper 49 may not necessarily be rotatably supported by the platen 42 but may be supported by the lateral frames 53 pivotably or vertically movably. In this configuration, the flapper 49 may be pivotable or movable downwardly by being pushed by the platen 42 or the ejection roller 62 moving downward.

For another example, it may not necessarily be the coil springs 86 that urge the flapper 49 upward. For example, the flapper 49 may be configured to weigh heavier at a rearward part than a frontward part with respect to the first projections 48 so that rearward part may tend to sink downward and the frontward part may be lifted upward by the effect of gravity.

For another example, when the flapper 49 is in the third condition, the upper edges 51 of the leaf members 46 may not necessarily align along the front-rear direction 8 but may incline with respect to the front-rear direction 8 to be closer to the second upper guide member 35 as the flapper 49 extends in the reverse direction 105, which is the opposite direction from the conveying direction 15. In other words, the upper edges 51 of the flapper 49 may incline in a way such that the height of the first conveyer path 65 in the vertical direction 8 is reduced toward the rear side along the reverse direction 105. According to this arrangement, the medium tray 110 conveyed in the reverse direction 105 may be guided along the upper edges 51; therefore, the medium tray 110 may be conveyed more smoothly in the first conveyer path 65.

For another example, in the embodiment described above, among the parts and members that are opposed to face each other to form the first conveyer path 65, the members on the lower side of the first conveyer path 65, e.g., the platen 42, the pinch roller 61, the ejection roller 62, the flapper 49, and the reversible roller 67, are moved by the movable member 90. However, the members on the upper side of the first conveyer path 65, e.g., the recording unit 24, the conveyer roller 60, the spur roller 63, the second upper guide member 35, and the spur roller 68, may be moved along with the movable member 90. For another example, both the members on the lower side and the upper side of the first conveyer path 65 may be vertically movable along with the movable member 90.

For another example, the second conveyer path 71 may not necessarily be in the configuration described above or illustrated in FIG. 2 as long as the sides of the recording sheet 12 to face with the recording unit 24 are reversible.

For example, the second conveyer path 71 may not be arranged on the lower side of the linear path 34 but may be arranged on the upper side of the linear path 34. In this configuration, the flapper 49 may be placed in a vertically inverted arrangement. Namely, the flapper 49 may be disposed on the upper side of the first conveyer path 65 to contact the members that define the lower side of the first conveyer path 65 when in the first condition. Further, the flapper 49 may be shifted from the first condition to the second condition or the third condition by pivoting upward.

For another example, the branch point 101 may not necessarily be on the downstream side of the recording unit 24 with regard to the conveying direction 15, or the merging point 102 may not necessarily be on the upstream side of the recording unit 24 with regard to the conveying direction 15.

For another example, the second conveyer path 71 may be in a configuration as depicted in FIG. 10. In FIG. 10, the branch point 101 and the merging point 102 may both be on the upstream side of the recording unit 24 in the first conveyer path 65 with regard to the conveying direction 15. Meanwhile, the merging point 102 may be arranged on the upstream side of the branch point 101 in the first conveyer path 65 with regard to the conveying direction 15. Further, the flapper 49 may be supported pivotably by the guide member 43 at the branch point 101. A first roller pair 107 may be arranged in a position between the flapper 49 and the recording unit 24 in the first conveyer path 65, and a second roller pair 108 may be arranged on the upstream side of the flapper 49 in the first conveyer path 65 with regard to the conveying direction 15. Furthermore, a third roller pair 109 may be arranged in the second conveyer path 71. The second roller pair 108 may include an intermediate roller 111 and a first driven roller 112. The third roller pair 109 may include the intermediate roller 111, which is common with the second roller pair 108, and a second driven roller 113.

For another example, the MFD 10 may not necessarily be equipped with the function to record an image on the disk surface of the recording medium supported on the medium tray 110. If this recording function to record the image on the recording medium is omitted, the members that are moved along with the movable member 90, including the flapper 49, the platen 42, and the pinch roller 61, the ejection roller 62, and the reversible roller 67, may be moved in order to remove the recording sheet 12 from the first conveyer path 65 to clear the sheet jam.

For another example, the sheet conveyer according to the embodiment may not necessarily convey the recording sheet 12 in the image recording apparatus to the image recording unit 24, which can record an image on the recording sheet 12 being conveyed, but may convey a sheet in an image reading apparatus to an image scanner, which can read an image recorded on the sheet being conveyed.

What is claimed is:

1. A conveyer device, comprising:

a chassis defining a first conveyer path, in which a sheet is conveyed in a conveying direction, and a second conveyer path, in which the sheet is conveyed and guided to reenter the first conveyer path;

a pair of path members arranged to oppose to each other and define a part of the first conveyer path;

a flapper disposed along the first conveyer path at a joint point, at which the first conveyer path and the second conveyer path are jointed, the flapper being configured to be pivotable among a first condition, in which the flapper blocks the first conveyer path and guides the sheet being conveyed in a reverse direction opposite from the conveying direction to the second conveyer path, a second condition, in which the flapper allows the sheet being conveyed in the conveying direction to pass thereby, and a third condition, in which the flapper is separated from an opposing member arranged to oppose to the flapper, the opposing member being arranged to contact the flapper when the flapper is in the first condition;

an urging member configured to urge the flapper toward the first condition; and a movable member including a first end positioned in the chassis and a second end that extends from the chassis, the movable member configured to be movable between a first position, in which the flapper in the first condition is contactless from the movable member, and a second position, in which the movable member contacts the flapper and moves the flapper to pivot from the first condition to the third condition, the movable member being configured to separate one of the pair of path members from the other of the pair of path members when the movable member moves from the first position to the second position, and wherein the first end of the movable member is positioned in the chassis in both the first and second positions.

2. The conveyer device according to claim 1, wherein the pair of path members comprises a roller pair configured to nip and convey the sheet in the first conveyer path, and wherein the movable member separates one of paired rollers in the roller pair from the other of the paired rollers in the roller pair when the movable member moves from the first position to the second position.

3. The conveyer device according to claim 2, further comprising:

a motor, wherein the roller pair comprise a driving roller configured to be rotated by rotation of the motor and a driven roller arranged to face with the driving roller, wherein the movable member moving from the first position to the second position shifts the roller pair from a contact condition, in which the driving roller and the driven roller contact each other, to a separated condition, in which the driving roller and the driven roller are separated from each other.

4. The conveyer device according to claim 3, wherein the roller pair in the contact condition is configured to convey the sheet, and wherein the roller pair in the separated condition is configured to convey a carrier member, of which thickness is greater than a thickness of the sheet.

5. The conveyer device according to claim 4, wherein the flapper comprises a guide plane configured to define a part of the first conveyer path, the guide plane being arranged to incline with respect to the conveying direction to be closer to the opposing member as the flapper in the third condition extends in the reverse direction.

6. The conveyer device according to claim 2, wherein the roller pair comprise a reversible roller pair arranged on a downstream of the joint point with regard to the conveying direction, the reversible roller pair being configured be rotatable in a normal rotating direction, in which the sheet in the first conveyer path nipped by the reversible roller pair is conveyed in the conveying direction, and in a reverse rotating direction, in which the sheet in the first conveyer path nipped by the reversible roller pair is conveyed in the reverse direction, and wherein the flapper is configured to guide the sheet conveyed by the reversible roller pair in the reverse direction to the second conveyer path when the flapper is in the first condition.

7. The conveyer device according to claim 1, wherein the movable member is arranged on an outside of the first conveyer path with regard to a widthwise direction which intersects with the conveying direction, wherein the flapper comprises a projection projecting outward along the widthwise direction, and wherein the projection is contactless from the movable member being in the first position and is configured to move the flapper to pivot from the first condition to the third condition by contacting the movable member moving from the first position to the second position.

8. The conveyer device according to claim 7, wherein the movable member comprises:

a slanted part formed to incline with respect to the conveying direction, the slanted part being configured to contact the projection and move the flapper to pivot from the first condition to the second condition through the projection when the movable member moves from the first position to the second position; and a retainer part configured to retain the projection thereon and maintain the flapper in the third condition through the projection when the movable member is in the second position.

9. The conveyer device according to claim 1, wherein the movable member comprises first and second pieces spaced apart from one another and positioned such that the flapper is situated between the first and second pieces.

10. The conveyer device according to claim 1, wherein the second end of the movable member comprises a handle.

11. The conveyer device according to claim 1, wherein the second end of the movable member extends farther from the chassis when the movable member is in the second position than when the movable member is in the first position.

12. An inkjet recording apparatus comprising:

a chassis defining a first conveyer path, in which a sheet is conveyed in a conveying direction, and a second conveyer path, in which the sheet is conveyed and guided to reenter the first conveyer path; and a conveyer device comprising:

a pair of path members arranged to oppose to each other and define a part of the first conveyer path;

a flapper disposed along the first conveyer path at a joint point, at which the first conveyer path and the second conveyer path are jointed, the flapper being configured to be pivotable among a first condition, in which the flapper blocks the first conveyer path and guides the sheet being conveyed in a reverse direction opposite from the conveying direction to the second conveyer path, a second condition, in which the flapper allows the sheet being conveyed in the conveying direction to pass thereby, and a third condition, in which the flapper is separated from an opposing member arranged to oppose to the flapper, the opposing member being arranged to contact the flapper when the flapper is in the first condition;

an urging member configured to urge the flapper toward the first condition; and a movable member including first and second pieces spaced apart from one another and positioned such that the flapper is situated between the first and second pieces, the movable member configured to be movable between a first position, in which the flapper in the first condition is contactless from the movable member, and a second position, in which the movable member contacts the flapper and moves the flapper to pivot from the first condition to the third condition, the movable member being configured to separate one of the pair of path members from the other of the pair of path members when the movable member moves from the first position to the second position, wherein the pair of path members comprises:

a platen configured to support the sheet in the first conveyer path; and a recording unit arranged along the first conveyer path to oppose to the platen, the recording unit being configured to discharge ink at the sheet supported on the platen, and wherein the movable member moving from the first position to the second position separates one of the platen and the recording unit from the other of the platen and the recording unit.

13. The inkjet recording apparatus according to claim 12, wherein the flapper is pivotably supported by the platen, and wherein the movable member moving from the first position to the second position separates the platen from the recording unit.

14. The inkjet recording apparatus according to claim 12, wherein the pair of path members comprises a roller pair configured to nip and convey the sheet in the first conveyer path, and wherein the roller pair comprise a reversible roller pair arranged on a downstream of the joint point with regard to the conveying direction, the reversible roller pair being configured be rotatable in a normal rotating direction, in which the sheet in the first conveyer path nipped by the reversible roller pair is conveyed in the conveying direction, and in a reverse rotating direction, in which the sheet in the first conveyer path nipped by the reversible roller pair is conveyed in the reverse direction, wherein the flapper is configured to guide the sheet conveyed by the reversible roller pair in the reverse direction to the second conveyer path when the flapper is in the first condition, wherein the second conveyer path is branched from the first conveyer path at a branch point, which is on a downstream of the recording unit with regard to the conveying direction, the second conveyer path being merged with the first conveyer path at a merging point, which is on an upstream of the recording unit with regard to the conveying direction, wherein the reversible roller pair is arranged on a downstream of the branch point with regard to the conveying direction, and wherein the roller pair further comprises a conveyer roller pair, which is arranged between the merging point and the recording unit with regard to the conveying direction, the conveyer roller pair being configured to nip the sheet in the first conveyer path and rotate in a normal rotation, in which the sheet in the first conveyer path nipped by the conveyer roller pair is conveyed in the conveying direction.

* * * * *